US008468990B2

(12) United States Patent
Yang et al.

(10) Patent No.: US 8,468,990 B2
(45) Date of Patent: Jun. 25, 2013

(54) CONTINUOUSLY VARIABLE VALVE TIMING APPARATUS

(75) Inventors: Jei Choon Yang, Yongin-si (KR); Byong Young Choi, Incheon (KR); Jin Kook Kong, Suwon-si (KR); Soo Hyung Woo, Yongin-si (KR); Jin Soon Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 60 days.

(21) Appl. No.: 13/214,688

(22) Filed: Aug. 22, 2011

(65) Prior Publication Data

US 2012/0111292 A1 May 10, 2012

(30) Foreign Application Priority Data

Nov. 8, 2010 (KR) ..... 10-2010-0110422

(51) Int. Cl.
*F01L 1/34* (2006.01)

(52) U.S. Cl.
USPC ..... 123/90.17; 123/90.31

(58) Field of Classification Search
USPC ..... 123/90.15, 90.17, 90.31
See application file for complete search history.

(56) References Cited

U.S. PATENT DOCUMENTS 5,542,383 A * 8/1996 Clarke et al. ..... 123/90.17

FOREIGN PATENT DOCUMENTS

| | | | |
|---|---|---|---|
| JP | 2644408 | B2 | 5/1997 |
| JP | 2007-100681 | A | 4/2007 |
| KR | 2002-0049229 | A | 6/2002 |
| KR | 10-2009-0051577 | A | 5/2009 |

* cited by examiner

*Primary Examiner* — Zelalem Eshete
(74) *Attorney, Agent, or Firm* — Morgan, Lewis & Bokius LLP

(57) ABSTRACT

Power consumption for maintaining a target valve timing and noise in operation is reduced by a continuously variable valve timing apparatus including a camshaft holder fixed to a camshaft, a cam sprocket, a leadscrew screw-coupled with the camshaft holder and the cam sprocket and is movable so as to rotate the camshaft holder and the cam sprocket in opposite directions, and an operating unit operated by a motor and moves the leadscrew.

5 Claims, 8 Drawing Sheets

CONTINUOUSLY VARIABLE VALVE TIMING APPARATUS

CROSS-REFERENCE TO RELATED APPLICATION

This application claims priority to and the benefit of Korean Patent Application No. 10-2010-0110422 filed Nov. 8, 2010, the entire contents of which application is incorporated herein for all purposes by this reference.

BACKGROUND OF INVENTION

1. Field of Invention

The present invention relates to a continuously variable valve timing apparatus (CVVT).

2. Description of Related Art

An internal combustion engine is an apparatus that generates power by burning fuel with intake air in a combustion chamber. Such an internal combustion engine is provided with intake valves to take in the air and fuel and exhaust valves to exhaust combustion gas from the combustion chamber. The intake valves and exhaust valves are operated by rotation of camshaft driven by the rotation of crankshaft.

Optimal timing of the intake and exhaust valves depends on various factors such as an engine speed and engine load. In such background, a variable valve timing (VVT) apparatus has been developed so that the camshaft is not fixedly but variably operated by the crankshaft depending on engine driving circumstances.

A continuously variable valve timing (CVVT) apparatus, which is an advanced type of variable valve timing (VVT) apparatus, has been developed to control the valve timing at an arbitrary value within a predetermined range.

Various schemes of a CVVT apparatus that are hydraulically or electrically controlled fail to provide a self-locking function, that is, a function that the target valve timing may be locked without substantially consuming control power. This means that substantial amount of electrical or hydraulic energy is consumed to maintain a target valve timing.

In addition, precise control of a cam angle becomes difficult because the CVVT apparatus typically uses a plurality of gears and grooves in which case tolerances of many components accumulatively add the difficulty. In addition, when gears are used in the CVVT apparatus, noise problem has been easily raised by backlash, which in turn results in the loss of durability.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various embodiments of the present invention provides continuously variable valve timing apparatus including a camshaft holder fixed to a camshaft, a cam sprocket, a leadscrew that is screw-coupled with the camshaft holder and the cam sprocket and is movable so as to rotate the camshaft holder and the cam sprocket in opposite directions, and an operating unit that is operated by a motor and moves the leadscrew.

The operating unit may include a screw nut having threads formed on an interior circumference and having an engagement portion on an exterior circumference so as to be coupled with the leadscrew, and a screw shaft that has threads on exterior circumference to be coupled with the screw nut and is connected with the motor.

The camshaft holder and the cam sprocket may be threaded in opposite directions, and the leadscrew may include threads of opposite directions that are respectively coupled with the camshaft holder and the cam sprocket.

Various aspects of the present invention provide for an interior circumference of the camshaft holder and an interior circumference of the cam sprocket may be threaded in opposite directions. The threads of opposite directions of the leadscrew to be coupled with the interior circumference of camshaft holder and the interior circumference of cam sprocket may be both formed on an exterior circumference of the leadscrew. An inner portion of the leadscrew may be secured between protrusions of the screw nut.

Other aspects provide for an exterior circumference of the camshaft holder and an interior circumference of the cam sprocket may be threaded in opposite directions. The threads of opposite directions of the leadscrew may be formed on an interior circumference and an exterior circumference of the leadscrew such that the interior circumference of the leadscrew is screw-coupled with the exterior circumference of the camshaft holder and the exterior circumference of the leadscrew is screw-coupled with the interior circumference of the cam sprocket. An inner portion of leadscrew may be secured between protrusions of the screw nut.

The motor may be disposed in a space formed by the camshaft holder and the leadscrew, and the screw shaft may extend from the motor in a direction opposite from the camshaft.

A bearing may be further included between the operating unit and the leadscrew.

The screw nut may include a protrusion elongated toward the motor, and the motor may be provided with a protrusion guide that receives the protrusion elongated toward the motor.

Various aspects of the present invention provide for components for varying the valve timing are screw-coupled and thus self-locking function is enabled. Thereby, power consumption to maintain a target valve timing is minimized, and noise by backlash is also minimized.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
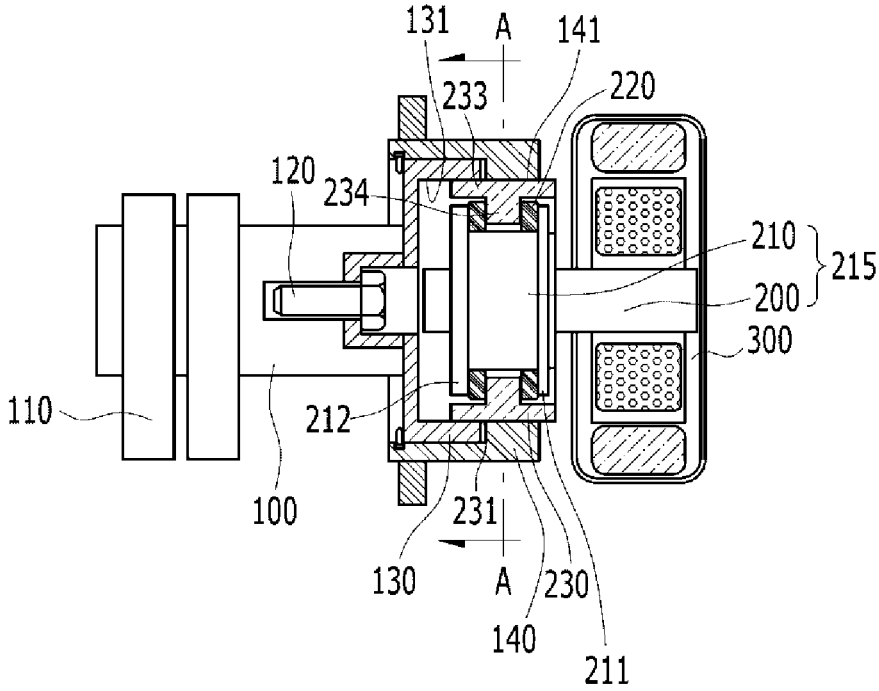
FIG. 1 is a cross-sectional view of an exemplary CVVT apparatus according to the present invention.
Figure 2:
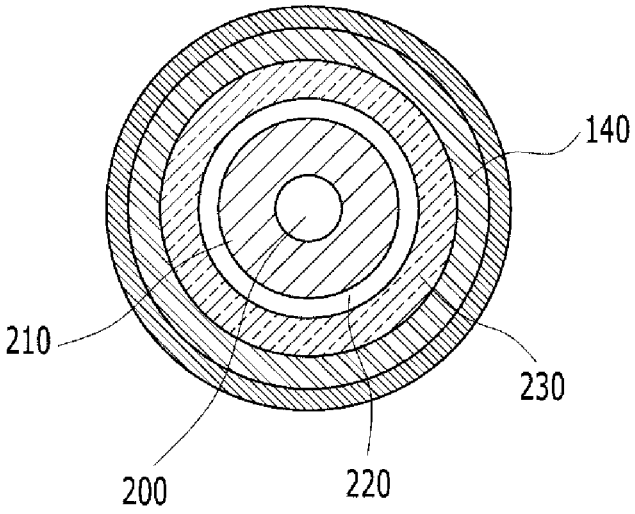
FIG. 2 is a cross-sectional view according to line A-A of FIG. 1.
Figure 3:
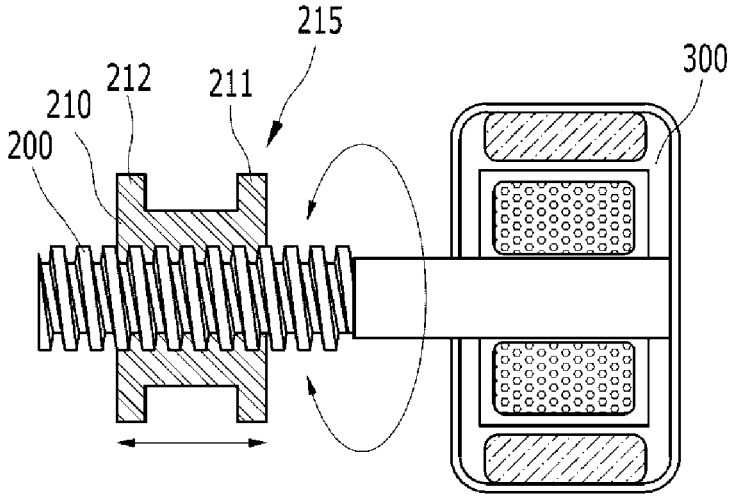
FIG. 3 is a cross-sectional view illustrating operation of an operating unit of an exemplary CVVT apparatus according to various embodiments of the present invention.

With reference to FIGS. 1-3, a CVVT apparatus according to various embodiments of the present invention includes a camshaft holder 130, a cam sprocket 140, a leadscrew 230, an operating unit 215, and a motor 300. The camshaft holder 130 is fixed to a camshaft 100 by a fixing element such as a bolt 120, and thus integrally rotates with the camshaft 100. The cam sprocket 140 is driven by a crankshaft by a chain or a belt. The leadscrew 230 is screw-coupled with both the camshaft holder 130 and the cam sprocket 140, and enables relative rotation of the camshaft holder 130 and the cam sprocket 140 in opposite directions. The operating unit 215 is screw-coupled with the leadscrew 230 and enables movement of the leadscrew 230. The operating unit 215 is operated by the motor 300.

As shown in FIG. 3, the operating unit 215 includes a screw nut 210 and a screw shaft 200. The screw nut 210 is threaded at its interior circumference, and the screw shaft 200 is threaded at its exterior circumference so that the screw shaft 200 is screw-coupled with the screw nut 210. Thus, rotation of the screw shaft 200 may be changed to linear motion of the screw nut 210.

Referring back to FIG. 1, the screw nut 210 is provided with protrusions 211 and 212 and the leadscrew 230 is secured at its inner portion 233 between the protrusions 211 and 212. Thus, the leadscrew 230 is linearly operated by the movement of the screw nut 210.

Figure 8:
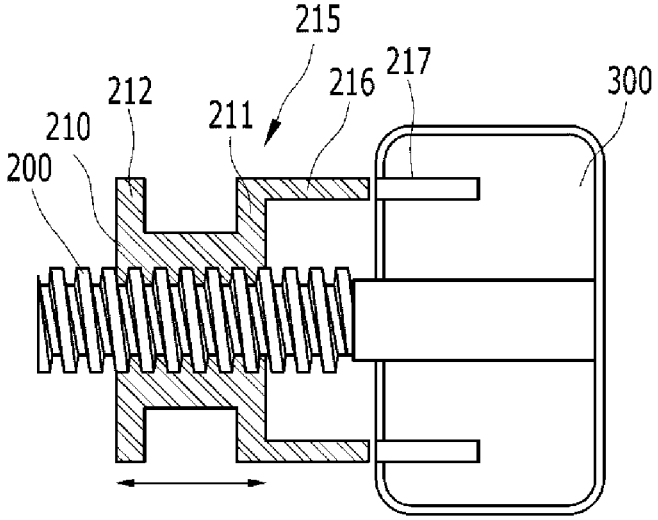
FIG. 8 is cross-sectional view that illustrates in detail an engagement of a motor and an operation unit according to various embodiments of the present invention.

The motor 300 is connected to an end of the screw shaft 200. As shown in FIG. 8, Protrusions 216 are formed at the protrusion 211 of the screw nut 210 in an axial direction of the screw shaft 200 toward the motor 300, and protrusion guides 217 that receives the protrusions 216 are formed in the motor. Thus, the motor rotates with the screw nut 210.

It is notable that the leadscrew 230, screw shaft 200, and screw nut 210 are screw-coupled and thus mechanically self-locked. This means that hydraulic or electrical power consumption is not required to maintain a target angle of the camshaft. Moreover, they are screw-coupled rather than gear-meshed, and thus noise due to backlash may be minimized.

A bearing 220 may be disposed between the screw nut 210 and the leadscrew 230 so that smooth relative rotation therebetween may be enabled.

According to various embodiments of the present invention, the camshaft holder 130 and the cam sprocket 140 are threaded in opposite directions and screw-coupled with the leadscrew 230 so that the camshaft holder 130 and the cam sprocket 140 may rotate in opposite direction when the leadscrew 230 linearly moves.

Figure 4:
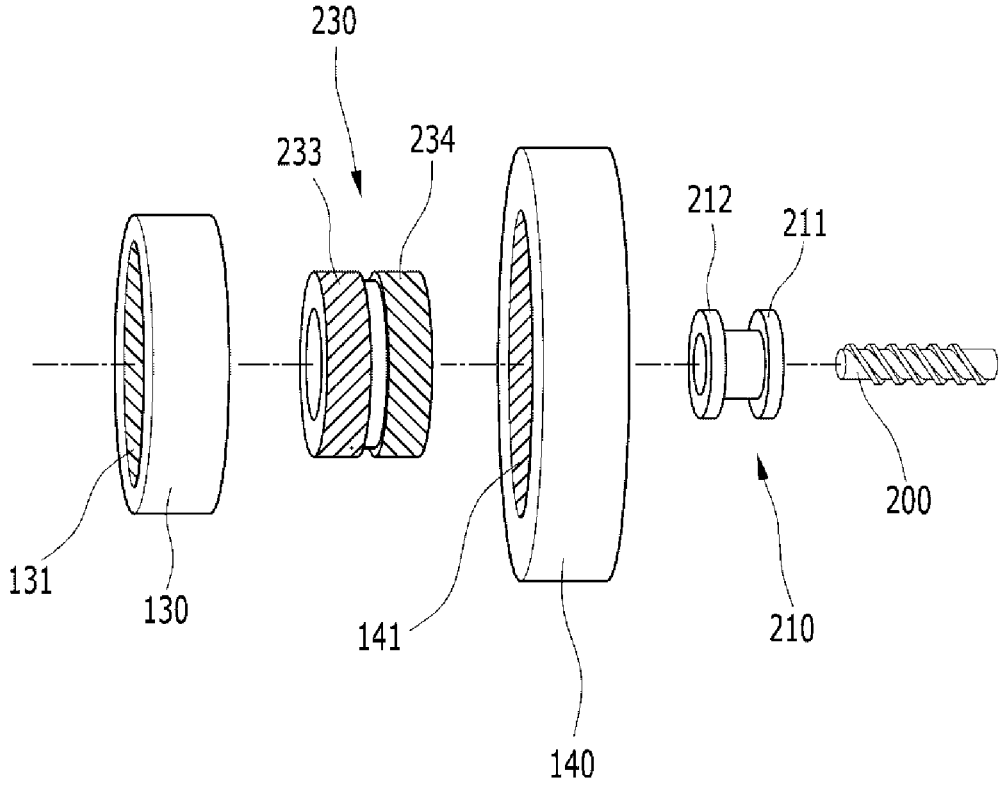
FIG. 4 is an exploded perspective view of principal parts of the CVVT apparatus of FIG. 1.

According to various embodiments of the present invention, as shown in FIG. 1, the camshaft holder 130 and the cam sprocket 140 are engaged with the outer portion 233 of the leadscrew 230. As shown in FIG. 4, left-hand threads are formed at one end of the exterior circumference 231 of the leadscrew 230 and right-hand threads are formed at another end of the exterior circumference 231 of the leadscrew 230. Left-hand threads that may be screw-coupled with the left-hand threads of the leadscrew 230 are formed on the interior circumference 131 of the camshaft holder 130. Right-hand threads that may be screw-coupled with the right-hand threads of the leadscrew 230 are formed on the interior circumference 141 of the cam sprocket 140.

By such an arrangement, the camshaft holder 130 and the cam sprocket 140 relatively rotate in opposite directions by back and forth movement of the leadscrew 230, so that an angular offset between the cam 110 and cam sprocket 140 may be varied.

With reference to FIG. 6C, threads of different directions are formed on the interior circumference 232 and the exterior circumference 231 of the outer portion 233 of the leadscrew 230. The exterior circumference 132 of the camshaft holder 130 is threaded to be coupled with the interior circumference 232 the outer portion 233 of the leadscrew 230, and the interior circumference 141 of the cam sprocket 140 is threaded to be coupled with the exterior circumference 231 the outer portion 233 of the leadscrew 230. The inner portion 234 of the leadscrew 230 is secured between protrusions 211 and 212 of the screw nut 210, By such an arrangement, the camshaft holder 130 and the cam sprocket 140 relatively rotate in opposite directions by back and forth movement of the leadscrew 230 therebetween, so that an angular offset between the cam 110 and cam sprocket 140 may be varied.

Figure 6:
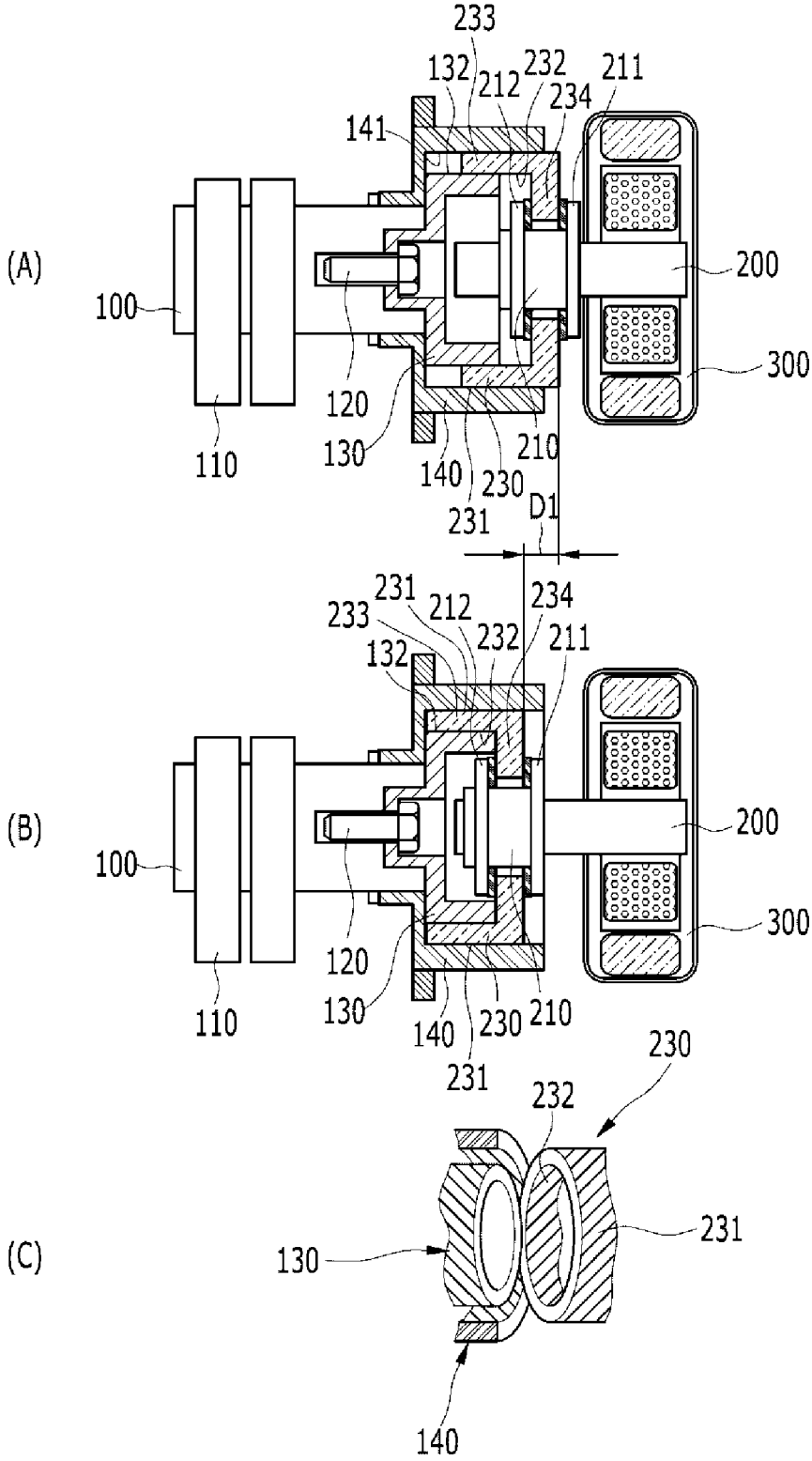
FIG. 6 is a cross-sectional view of an exemplary CVVT apparatus according to the present invention.
Figure 7:
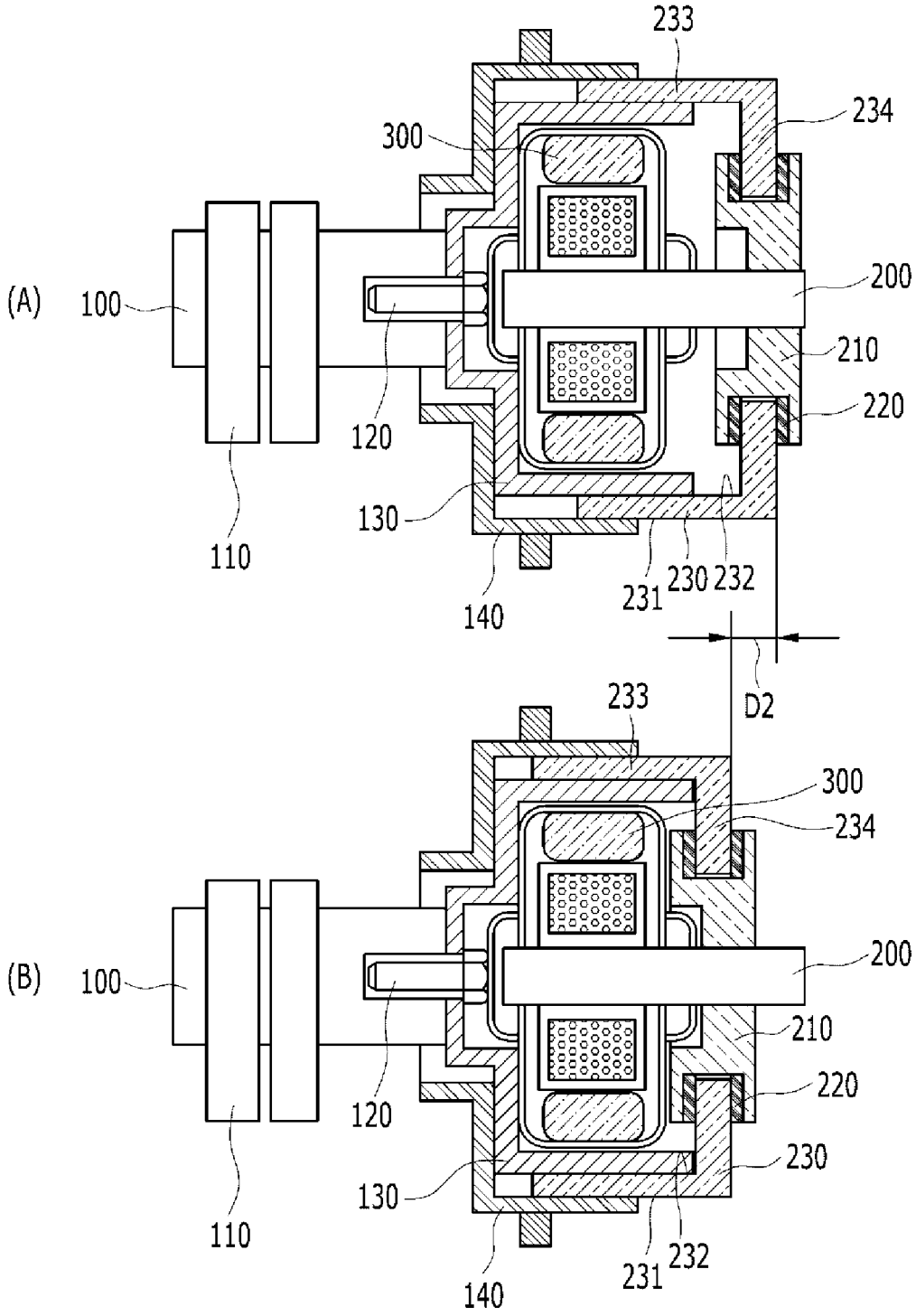
FIG. 7 is a cross-sectional view of an exemplary CVVT apparatus according to the present invention.

As shown in FIG. 7, a CVVT apparatus according to various embodiments of the present invention has a similar scheme to the CVVT apparatus described above, and in particular the one illustrated in FIG. 6, except in that the camshaft holder 130 and the cam sprocket 140 are axially elongated such that a space is formed therebetween and the motor 300 is installed in the space. By such an arrangement, a size of a CVVT apparatus may be more down-sized.

An operation of a CVVT apparatus according to various embodiments is hereinafter described in detail.

Referring back to FIG. 1, according to various embodiments of the present invention, normally, the cam sprocket 140 driven by crankshaft, the leadscrew 230 driven by the cam sprocket 140, and the camshaft holder 130 driven by the leadscrew 230 integrally rotate at the same rotation speed.

In the case of advancing the valve timing, the screw shaft 200 is rotated by operating the motor 300. Then, the screw nut 210 moves forward (in right direction in FIG. 3), and thus the leadscrew 230 moves forward.

Figure 5:
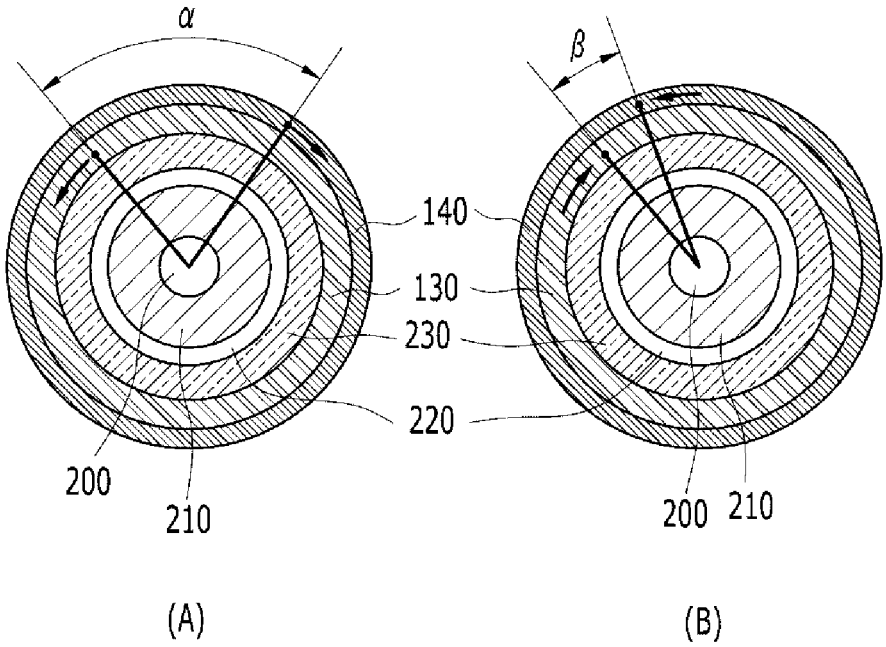
FIG. 5 shows cross-sectional views that illustrates phase difference between a camshaft holder and a cam sprocket at advance and regarded states of a CVVT apparatus according to various embodiments of the present invention.

Since the camshaft holder 130 and cam sprocket 140 are coupled with the leadscrew 230 by threads of opposite directions, angular difference between the camshaft holder 130 and the cam sprocket 140 is enlarged such that the valve timing may be advanced as shown in FIG. 5A.

In the case of retarding the valve timing, the screw shaft 200 is oppositely rotated by operating the motor 300 so that screw shaft 200 moves rearward (in left direction in FIG. 3). Thus, the leadscrew 230 moves rearward, and the camshaft holder 130 and cam sprocket 140 rotates in opposite directions so as to decrease their angular difference such that the valve timing may be advanced as shown in FIG. 5B.

Referring to FIG. 6, the CVVT apparatus according to various embodiments also performs advance and retardation of valve timing in the same way as that shown in FIG. 1. FIG. 6A illustrates a state of maximally allowed advanced valve timing, and FIG. 6B illustrates a state of maximally allowed retarded valve timing. The travel distance D1 indicate the maximum range of variation of valve timing.

Referring to FIG. 7, the CVVT apparatus according to various embodiments also performs advance and retardation of valve timing in the same way as those described above, because it is mainly different from that shown in FIG. 6 in that the motor 300 is located in a space formed by the camshaft holder 130 and the leadscrew 230. The travel distance D2 indicate the maximum range of variation of valve timing For convenience in explanation and accurate definition in the appended claims, the terms rearward and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve timing apparatus comprising:

a camshaft holder fixed to a camshaft;

a cam sprocket;

a leadscrew screw-coupled with the camshaft holder and the cam sprocket and is movable so as to rotate the camshaft holder and the cam sprocket in opposite directions; and an operating unit operated by a motor and moves the leadscrew, wherein the operating unit comprises:

a screw nut having threads formed along an interior circumference and having an engagement portion on an exterior circumference coupled with the leadscrew; and a screw shaft having threads on exterior circumference coupled with the screw nut and is connected with the motor;

wherein the camshaft holder and the cam sprocket are threaded in opposite directions;

wherein the leadscrew includes opposing threads that are respectively coupled with the camshaft holder and the cam sprocket;

wherein an interior circumference of the camshaft holder and an interior circumference of the cam sprocket are threaded in opposite directions;

wherein the opposing threads of the leadscrew coupled with the interior circumference of camshaft holder and the interior circumference of cam sprocket are both formed on an exterior circumference of the leadscrew; and wherein an inner portion of the leadscrew is secured between protrusions of the screw nut.

2. The continuously variable valve timing apparatus of claim 1, wherein:

an exterior circumference of the camshaft holder and an interior circumference of the cam sprocket are threaded in opposite directions;

the opposing threads of the leadscrew are formed on an interior circumference and an exterior circumference of the leadscrew such that the interior circumference of the leadscrew is screw-coupled with the exterior circumference of the camshaft holder and the exterior circumference of the leadscrew is screw-coupled with the interior circumference of the cam sprocket; and an inner portion of leadscrew is secured between protrusions of the screw nut.

3. The continuously variable valve timing apparatus of claim 2, wherein:

the motor is disposed in a space formed by the camshaft holder and the leadscrew; and the screw shaft extends from the motor in a direction opposite from the camshaft.

4. The continuously variable valve timing apparatus of claim 1, further comprising a bearing between the operating unit and the leadscrew.

5. The continuously variable valve timing apparatus of claim 1, wherein:

the screw nut comprises a protrusion elongated toward the motor; and the motor is provided with a protrusion guide that receives the protrusion elongated toward the motor.

* * * * *